US009644441B2

(12) United States Patent
Hradecky

(10) Patent No.: US 9,644,441 B2
(45) Date of Patent: May 9, 2017

(54) HYDRAULIC IMPACT APPARATUS AND METHODS

(71) Applicant: Impact Selector, Inc., Heath, TX (US)

(72) Inventor: Jason Allen Hradecky, The Woodlands, TX (US)

(73) Assignee: Impact Selector International, LLC, Houma, LA (US)

( * ) Notice: Subject to any disclaimer, the term of this patent is extended or adjusted under 35 U.S.C. 154(b) by 273 days.

(21) Appl. No.: 14/510,762

(22) Filed: Oct. 9, 2014

(65) Prior Publication Data

US 2016/0102515 A1 Apr. 14, 2016

(51) Int. Cl.
*E21B 31/113* (2006.01)

(52) U.S. Cl.
CPC ..... *E21B 31/1135* (2013.01)

(58) Field of Classification Search
CPC .. E21B 31/107; E21B 31/113; E21B 31/1135; E21B 31/00
USPC ..... 166/178
See application file for complete search history.

(56) References Cited

U.S. PATENT DOCUMENTS 4,478,284 A * 10/1984 Tomm ..... E21B 31/113 166/297
5,086,853 A 2/1992 Evans
5,318,139 A 6/1994 Evans
5,330,018 A 7/1994 Griffith
5,411,107 A 5/1995 Hailey et al.
5,425,430 A 6/1995 Roberts
5,431,221 A 7/1995 Roberts et al.
5,447,196 A 9/1995 Roberts
5,494,105 A 2/1996 Morris
5,495,902 A 3/1996 Hailey et al.
5,503,228 A 4/1996 Anderson
5,507,347 A 4/1996 Estilette
5,580,114 A 12/1996 Palmer
5,584,353 A 12/1996 Chancey et al.
5,595,244 A 1/1997 Roberts
(Continued)

FOREIGN PATENT DOCUMENTS

CA 2436588 7/2002
CA 2460660 6/2007
(Continued)

OTHER PUBLICATIONS

International Search Report and Written Opinion dated Jun. 9, 2015, International App. No. PCT/2014/059916, 10 pages.

*Primary Examiner* — Kenneth L Thompson
*Assistant Examiner* — David Carroll
(74) *Attorney, Agent, or Firm* — Boisbrun Hofman, PLlC

(57) ABSTRACT

A hydraulic jar coupled between opposing first and second portions of a downhole tool string. The hydraulic jar includes a housing comprising a shoulder protruding radially inward from an internal surface of the housing, a shaft disposed within the housing, a piston fixedly positioned about the shaft and fluidly sealed against the shoulder, and a pressure relief device. The housing and the shaft move axially relative to each other and the shoulder axially interposes first and second portions of an annulus formed between the shaft and the housing. The pressure relief device controls fluid flow from the first annulus portion to the second annulus portion based on a pressure of the fluid in the first annulus portion relative to a set pressure of the pressure relief device.

18 Claims, 8 Drawing Sheets

(56) References Cited

U.S. PATENT DOCUMENTS

| | | | |
|---|---|---|---|
| 5,595,253 | A | 1/1997 | Martin et al. |
| 5,624,001 | A | 4/1997 | Evans |
| 5,647,446 | A | 7/1997 | Wenzel |
| 5,709,268 | A | 1/1998 | Estilette |
| 5,752,571 | A | 5/1998 | Sapozhnikov |
| 5,775,423 | A | 7/1998 | Kaczynski |
| 5,791,420 | A | 8/1998 | Budney |
| 5,791,712 | A | 8/1998 | Hawn |
| 5,803,182 | A | 9/1998 | Bakke |
| 5,806,610 | A | 9/1998 | Sapozhnikov |
| 5,906,239 | A | 5/1999 | Oettli |
| 5,918,688 | A | 7/1999 | Evans |
| 5,918,689 | A | 7/1999 | Roberts |
| 5,931,242 | A | 8/1999 | Oettli |
| 5,984,028 | A | 11/1999 | Wilson |
| 6,070,672 | A | 6/2000 | Gazda |
| 6,082,457 | A | 7/2000 | Best et al. |
| 6,095,583 | A | 8/2000 | Beeman et al. |
| 6,135,217 | A | 10/2000 | Wilson |
| 6,164,393 | A | 12/2000 | Bakke |
| 6,182,775 | B1 | 2/2001 | Hipp |
| 6,202,767 | B1 | 3/2001 | Friis |
| 6,263,986 | B1 | 7/2001 | Massner et al. |
| 6,290,004 | B1 | 9/2001 | Evans |
| 6,308,779 | B1 | 10/2001 | McNeilly et al. |
| 6,328,101 | B1 | 12/2001 | Friis |
| 6,338,387 | B1 | 1/2002 | Mouton et al. |
| 6,453,997 | B1 | 9/2002 | McNeilly et al. |
| 6,481,495 | B1 | 11/2002 | Evans |
| 6,502,638 | B1 | 1/2003 | Stoesz |
| 6,527,048 | B1 | 3/2003 | Trosclair |
| 6,640,899 | B2 | 11/2003 | Day et al. |
| 6,655,460 | B2 | 12/2003 | Bailey et al. |
| 6,675,909 | B1 | 1/2004 | Cowart et al. |
| 6,712,134 | B2 | 3/2004 | Stoesz |
| 6,725,932 | B2 | 4/2004 | Taylor et al. |
| 6,729,419 | B1 | 5/2004 | Lee |
| 6,782,951 | B2 | 8/2004 | Taylor et al. |
| 6,948,560 | B2 | 9/2005 | Marsh |
| 6,986,394 | B2 | 1/2006 | Marsh |
| 6,988,551 | B2 | 1/2006 | Evans |
| 6,991,035 | B2 | 1/2006 | Hall et al. |
| 7,011,156 | B2 | 3/2006 | von Gynz-Rekowski |
| 7,025,130 | B2 | 4/2006 | Bailey et al. |
| 7,051,810 | B2 | 5/2006 | Campbell et al. |
| 7,066,251 | B2 | 6/2006 | Streater et al. |
| 7,066,263 | B1 | 6/2006 | Mouton |
| 7,073,610 | B2 | 7/2006 | Susman |
| 7,163,058 | B2 | 1/2007 | Bakke |
| 7,163,059 | B2 | 1/2007 | Elder |
| 7,264,055 | B2 | 9/2007 | Mody et al. |
| 7,267,176 | B2 | 9/2007 | Madden |
| 7,290,604 | B2 | 11/2007 | Evans |
| 7,293,614 | B2 | 11/2007 | Rose |
| 7,299,872 | B2 | 11/2007 | Darnell |
| 7,303,020 | B2 | 12/2007 | Bishop et al. |
| 7,311,149 | B2 | 12/2007 | Evans |
| 7,325,614 | B2 | 2/2008 | Elder |
| 7,347,287 | B2 | 3/2008 | Chancey |
| 7,367,397 | B2 | 5/2008 | Clemens et al. |
| 7,373,974 | B2 | 5/2008 | Connell et al. |
| 7,395,862 | B2 | 7/2008 | Ross et al. |
| 7,434,623 | B2 | 10/2008 | von Gynz-Rekowski |
| 7,451,834 | B2 | 11/2008 | Shears et al. |
| 7,510,008 | B2 | 3/2009 | Evans |
| 7,533,724 | B2 | 5/2009 | McLaughlin |
| 7,559,361 | B2 | 7/2009 | Obrejanu |
| 7,721,800 | B2 | 5/2010 | Heselton et al. |
| 7,753,116 | B2 | 7/2010 | Budney et al. |
| 7,775,280 | B2 | 8/2010 | Rose |
| 7,814,995 | B2 | 10/2010 | Clausen et al. |
| 7,828,052 | B2 | 11/2010 | Obrejanu |
| 7,874,364 | B2 | 1/2011 | Redlinger et al. |
| 7,882,906 | B1 | 2/2011 | DeCuir |
| 7,900,695 | B2 | 3/2011 | Unsgaard |
| 7,905,289 | B2 | 3/2011 | Budney et al. |
| 8,011,427 | B2 | 9/2011 | Budney et al. |
| 8,052,176 | B2 | 11/2011 | Shears et al. |
| 8,074,716 | B2 | 12/2011 | Champagne et al. |
| 8,141,634 | B2 | 3/2012 | Fisher et al. |
| 8,151,910 | B2 | 4/2012 | Swinford |
| 8,205,690 | B2 | 6/2012 | Evans |
| 8,230,912 | B1 | 7/2012 | Connell |
| 8,256,509 | B2 | 9/2012 | Evans |
| 8,347,964 | B2 | 1/2013 | Fisher et al. |
| 8,365,818 | B2 | 2/2013 | Schultz et al. |
| 8,365,826 | B2 | 2/2013 | Braddick |
| 8,443,902 | B2 | 5/2013 | Evans |
| 8,505,653 | B2 | 8/2013 | Shoyhetman et al. |
| 8,550,155 | B2 | 10/2013 | Schultz et al. |
| 8,561,688 | B2 | 10/2013 | Evans |
| 8,657,007 | B1 | 2/2014 | Watson et al. |
| 8,695,696 | B2 | 4/2014 | Shoyhetman et al. |
| 8,783,354 | B2 | 7/2014 | Clausen et al. |
| 2003/0145994 | A1* | 8/2003 | Gatherar ..... E21B 33/076 166/339 |
| 2007/0074867 | A1 | 4/2007 | Chancey |
| 2008/0115941 | A1 | 5/2008 | Elder |
| 2008/0236894 | A1* | 10/2008 | Clausen ..... E21B 31/1135 175/57 |
| 2009/0266544 | A1 | 10/2009 | Antoine et al. |
| 2009/0301744 | A1 | 12/2009 | Swinford |
| 2009/0301745 | A1 | 12/2009 | Akselberg |
| 2010/0258314 | A1 | 10/2010 | Rose |
| 2011/0209918 | A1 | 9/2011 | Saheta |
| 2012/0018144 | A1 | 1/2012 | Shoyhetman et al. |
| 2012/0090843 | A1 | 4/2012 | Ishbaev et al. |
| 2012/0118641 | A1 | 5/2012 | Clausen et al. |
| 2012/0160477 | A1 | 6/2012 | Prokopchuk |
| 2013/0062052 | A1 | 3/2013 | Saheta et al. |
| 2013/0186689 | A1 | 7/2013 | Garcia et al. |
| 2013/0248253 | A1 | 9/2013 | Johnson |
| 2013/0277057 | A1 | 10/2013 | Evans |
| 2016/0102516 | A1 | 4/2016 | Hradecky |

FOREIGN PATENT DOCUMENTS

| | | | |
|---|---|---|---|
| CA | 2302977 | | 7/2008 |
| CA | 2681471 | | 9/2008 |
| CA | 2767086 | C | 1/2011 |
| CA | 2823177 | | 7/2012 |
| CN | 203476271 | U | 3/2014 |
| GB | 2474603 | | 4/2011 |
| NO | 20073009 | | 12/2008 |
| WO | 2008115952 | A1 | 9/2008 |
| WO | 2012091716 | A | 7/2012 |
| WO | 2013040578 | A2 | 3/2013 |
| WO | 2016057040 | A1 | 4/2016 |

* cited by examiner

HYDRAULIC IMPACT APPARATUS AND METHODS

BACKGROUND OF THE DISCLOSURE

Drilling operations have become increasingly expensive as the need to drill deeper, in harsher environments, and through more difficult materials have become reality. Additionally, testing and evaluation of completed and partially finished wellbores has become commonplace, such as to increase well production and return on investment.

In working with deeper and more complex wellbores, it becomes more likely that tools, tool strings, and/or other downhole apparatus may become stuck within the wellbore. In addition to the potential to damage equipment in trying to retrieve it, the construction and/or operation of the well must generally stop while tools are fished from the wellbore. The fishing operations themselves may also damage the wellbore and/or the downhole apparatus.

Furthermore, downhole tools used in fishing operations are regularly subjected to high temperatures, temperature changes, high pressures, and the other rigors of the downhole environment. Consequently, internal components of the downhole tools may be subjected to repeated stresses that may compromise reliability. One such downhole tool, referred to as a jar, may be used to dislodge a downhole apparatus when it becomes stuck within a wellbore. The jar is positioned in the tool string and/or otherwise deployed downhole to free the downhole apparatus. Tension load is applied to the tool string to trigger the jar, thus delivering an impact intended to dislodge the stuck downhole apparatus.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
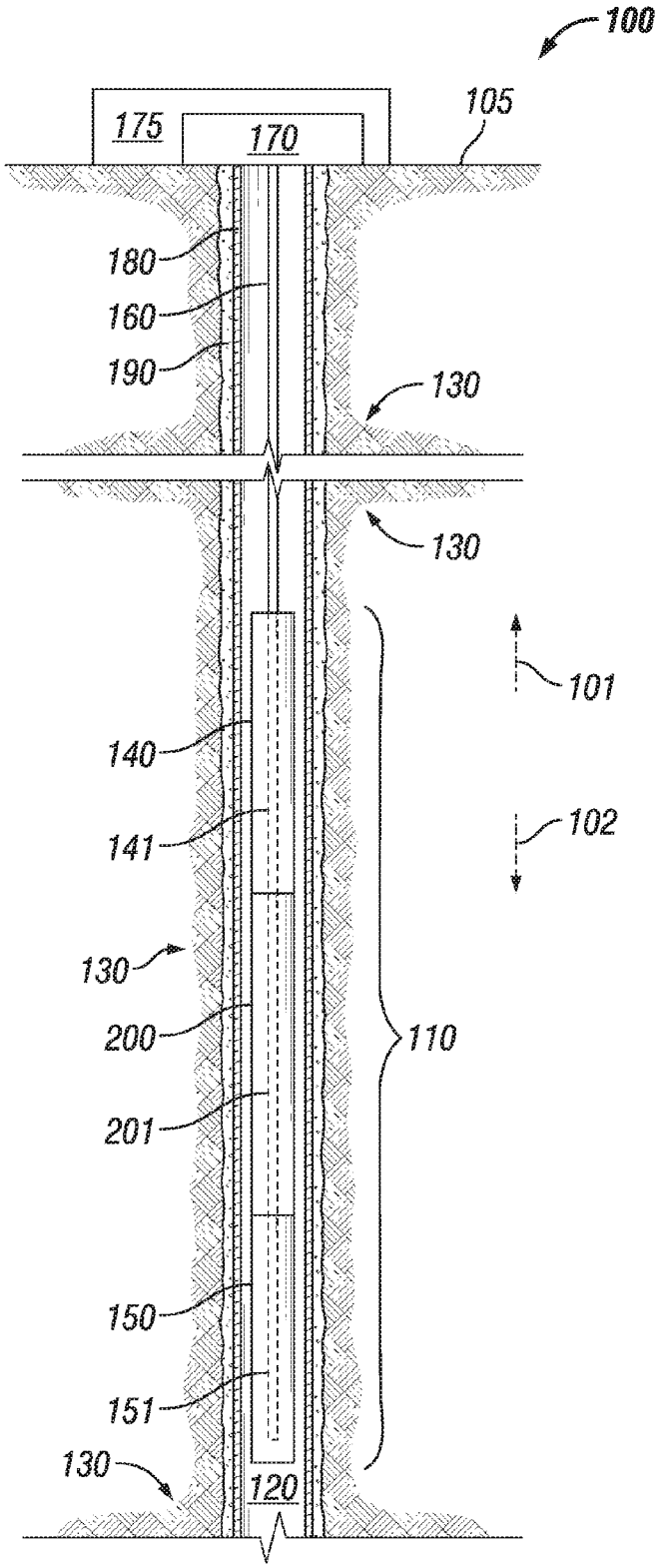
FIG. 1 is a sectional view of at least a portion of apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for simplicity and clarity, and does not in itself dictate a relationship between the various embodiments and/or configurations discussed. Moreover, the formation of a first feature over or on a second feature in the description that follows, may include embodiments in which the first and second features are formed in direct contact, and may also include embodiments in which additional features may be formed interposing the first and second features, such that the first and second features may not be in direct contact.

FIG. 1 is a sectional view of at least a portion of an implementation of a wellsite system 100 according to one or more aspects of the present disclosure. The wellsite system 100 comprises a tool string 110 suspended within a wellbore 120 that extends from a wellsite surface 105 into one or more subterranean formations 130. The tool string 110 comprises a first portion 140, a second portion 150, and a hydraulic jar, referred to hereinafter as the hydraulic impact apparatus (HIA) 200, coupled between the first portion 140 and the second portion 150, wherein the HIA 200 is operable to impart an impact to at least a portion of the tool string 110. The tool string 110 is suspended within the wellbore 120 via conveyance means 160 operably coupled with a tensioning device 170 and/or other surface equipment 175 disposed at the wellsite surface 105.

The wellbore 120 is depicted in FIG. 1 as being a cased-hole implementation comprising a casing 180 secured by cement 190. However, one or more aspects of the present disclosure are also applicable to and/or readily adaptable for utilizing in open-hole implementations lacking the casing 180 and cement 190.

The tensioning device 170 is operable to apply an adjustable tensile force to the tool string 110 via the conveyance means 160. Although depicted schematically in FIG. 1, a person having ordinary skill in the art will recognize the tensioning device 170 as being, comprising, or forming at least a portion of a crane, winch, drawworks, top drive, and/or other lifting device coupled to the tool string 110 by the conveyance means 160. The conveyance means 160 is or comprises wireline, slickline, e-line, coiled tubing, drill pipe, production tubing, and/or other conveyance means, and comprises and/or is operable in conjunction with means for communication between the tool string 110 and the tensioning device 170 and/or one or more other portions of the various surface equipment 175.

The first and second portions 140 and 150 of the tool string 110 may each be or comprise one or more downhole tools, modules, and/or other apparatus operable in wireline, while-drilling, coiled tubing, completion, production, and/or other implementations. The first portion 140 of the tool string 110 also comprises at least one electrical conductor 141 in electrical communication with at least one component of the surface equipment 175, and the second portion 150 of the tool string 110 also comprises at least one electrical conductor 151 in electrical communication with at least one component of the surface equipment 175, wherein the at least one electrical conductor 141 of the first portion 140 of the tool string 110 and the at least one electrical conductor 151 of the second portion 150 of the tool string 110 may be in electrical communication via at least one or more electrical conductors 201 of the HIA 200. Thus, the one or more electrical conductors 141, 201, 151, and/or others may collectively extend from the conveyance means 160 and/or the first tool string portion 140, into the HIA 200, and perhaps into the second tool string portion 150, and may include various electrical connectors along such path.

The HIA 200 may be employed to retrieve a portion of the tool string 110 that has become lodged or stuck within the wellbore 120, such as the second portion 150. The HIA 200 may be coupled to the second portion 150 of the tool string 110 before the tool string 110 is conveyed into the wellbore, such as in prophylactic applications, or after at least a portion of the tool string 110 (e.g., the second portion 150) has become lodged or stuck in the wellbore 120, such as in "fishing" applications.

Figure 2:
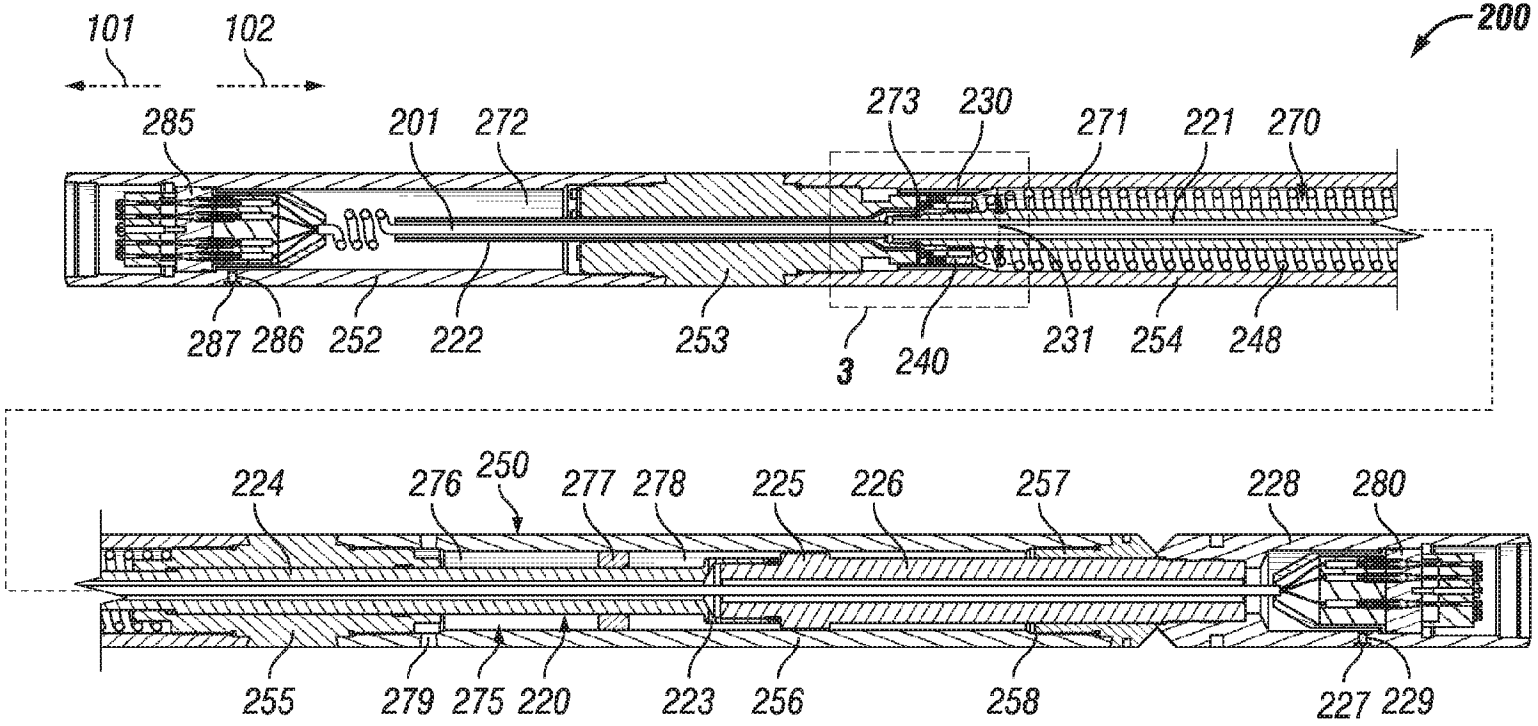
FIG. 2 is a sectional view of an example implementation of a portion of the apparatus shown in FIG. 1 according to one or more aspects of the present disclosure.

FIG. 2 is a sectional view of at least a portion of an example implementation of the HIA 200 shown in FIG. 1. Referring to FIGS. 1 and 2, collectively, the HIA 200 may comprise an electrical conductor 201 in electrical communication with the electrical conductor 141 of the first portion 140 of the tool string 110. For example, one or more electrical bulkhead connectors and/or other electrically conductive members 285 may at least partially connect or extend between the electrical conductor 201 of the HIA 200 and the electrical conductor 141 of the first portion 140 of the tool string 110. The electrical conductor 201 may also be in electrical communication with the electrical conductor 151 of the second portion 150 of the tool string 110. For example, one or more electrical bulkhead connectors and/or other electrically conductive members 280 may extend between the electrical conductor 201 of the HIA 200 and the electrical conductor 151 of the second portion 150 of the tool string 110. Thus, the electrical conductor 141 of the first portion 140 of the tool string 110 may be in electrical communication with the electrical conductor 151 of the second portion 150 of the tool string 110 via the electrical conductor 201 of the HIA 200 and perhaps one or more electrical bulkhead connectors and/or other electrical connectors 280, 285. Furthermore, the electrical conductor 141 of the first portion 140 of the tool string 110, the electrical conductor 201 of the HIA 200, and the electrical conductor 151 of the second portion 150 of the tool string 110, and perhaps one or more other electrical connectors 280, 285, may be in electrical communication with the surface equipment 175, such as via the conveyance means 160.

As at least partially shown in FIG. 2, the HIA 200 comprises a housing assembly 250 made up of several portions, such as an uphole (hereinafter "upper") housing 252, an upper housing connector 253 coupled with the upper housing 252, an intermediate housing 254 coupled with the upper housing connector 253, a downhole (hereinafter "lower") housing connector 255 coupled with the intermediate housing 254, a lower housing 256 coupled with the lower housing connector 255, and a stop section 257 coupled with the lower housing 256. Each portion of the housing assembly 250 may be substantially tubular, comprising at least one central passage and/or other passages extending longitudinally therethrough.

The upper housing 252 may comprise a female-threaded and/or other interface operable to couple the HIA 200 with the first portion 140 of the tool string 110. The intermediate housing 254 may comprise a shoulder 230 protruding radially inward, wherein the shoulder 230 may comprise an inside diameter 231 that is substantially smaller than the surrounding portions of the intermediate housing 254. For example, the reduced diameter 231 may be smaller in diameter, relative to the surrounding portions of the intermediate housing 254, by an amount ranging between about 10% and about 50%. The reduced diameter 231 may range between about 0.5 inches (or about 1.3 centimeters) and about 3.5 inches (or about 8.9 centimeters) less than surrounding portions of the intermediate housing 254, although other values are also within the scope of the present disclosure.

The HIA 200 may also comprise a mandrel assembly 220 slidably disposed within a central longitudinal passageway extending through one or more components of the housing assembly 250. The housing assembly 250 and the mandrel assembly 220 move in axially opposing directions relative to each other.

The mandrel assembly 220 may comprise several portions coupled together and defining a central bore 221 extending longitudinally therethrough. For example, the mandrel assembly 220 may comprise an upper mandrel 222 slidably extending within the upper housing connector 253, an intermediate mandrel 224 coupled with the upper mandrel 222 and slidably extending within the lower housing connector 255, a lower mandrel 226 coupled with the intermediate mandrel 224 and slidably extending within the stop section 257, and a lower joint connector 228 coupled with the lower mandrel 226. The upper housing connector 253, the lower housing connector 255, and the stop section 257 may comprise central passageways having smaller inside diameters operable to centralize the mandrel assembly 220 within the housing assembly 250 and/or form fluid seals against the mandrel assembly 220. The lower joint connector 228 may comprise a female thread operable to couple the HIA 200 with the second portion 150 of the tool string 110. An outwardly extending radial shoulder, boss, flange, and/or other impact feature 225 may be coupled to the lower mandrel 226. The first impact feature 225 is operable to impact or collide with an inwardly extending radial shoulder, boss, flange, and/or other impact feature 258, which may be integral to or otherwise carried by the stop section 257 and/or other component of the housing assembly 250.

An annular space 270 may be defined between the mandrel assembly 220 and the housing assembly 250. The annular space 270 may comprise a first or lower annulus 271, a second or upper annulus 272, a third or intermediate annulus 273, and a fourth or compensation annulus 275. Each annulus 271, 272, 273, 275 of the annular space 270 is operable to hold a fluid (hereinafter "internal fluid") therein, whereby, during operations, the internal fluid may flow between the annuluses in a particular configuration.

The housing assembly 250 may comprise one or more fluid sealing elements, such as may prevent the internal fluid from escaping or leaking from within the HIA 200. The HIA 200 may also comprise one or more fluid sealing elements that may prevent the internal fluid from communicating between the annuluses 271, 272, 273, 275 until predetermined conditions are met.

The internal fluid located within the HIA 200 may be fluidly isolated from the first portion 140 of the tool string 110 by the electrical connector 285 disposed within the upper housing 252. The electrical connector 285 may be operable to prevent the internal fluid from communicating in the uphole direction 101 from the upper annulus 272 of the HIA 200 into the first portion 140 of the tool string 110. The internal fluid located within the HIA 200 may also be fluidly isolated from the second portion 150 of the tool string 110 by the electrical connector 280 disposed within the lower joint connector 228. The electrical connector 280 may be operable to prevent fluid communication in the downhole direction 102 from within the lower joint connector 228 of the HIA 200 into the second portion 150 of the tool string 110.

Prior to operations, the internal fluid, which may be a hydraulic oil or other fluid, may be fed into the HIA 200 through fill ports 286, 229 located in the upper housing 252 and the lower joint connector 228, respectively. Prior to introduction of the internal fluid into the HIA 200, substantially all of the air may be extracted to facilitate the internal fluid filling the annular space 270 and other internal spaces of the HIA 200, although other methods may also or instead be utilized to fill the intended portion(s) of the HIA 200 without leaving air therein. Once the HIA 200 is satisfactorily filled with the internal fluid, the fill ports 286, 229, may be closed by plugs 287, 227 respectfully.

The shoulder 230 may interpose the upper and lower annuluses 272, 271. The pressure compensation annulus 275 may be defined between the lower housing connector 255 and the stop section 257. A floating piston 277 may be disposed within the pressure compensation annulus 275, such as to define a lower portion 278 of the pressure compensation annulus 275 from an upper portion 276 of the pressure compensation annulus 275. The upper portion 276 may be in fluid communication with wellbore fluid located in the wellbore 120, such as through one or more ports 279, and the lower portion 278 may be in fluid communication with the internal fluid previously introduced into the HIA 200. During operations, as the housing assembly 250 moves axially relative to the mandrel assembly 220, the internal fluid may be communicated into and out of the lower portion 278 through one or more mandrel ports 223 extending between the central bore 221 and the lower portion 278. The lower housing connector 255 and the floating piston 277 may be operable to prevent the wellbore fluid in the upper portion 276 from leaking into and contaminating the internal fluid contained within the lower portion 278 and other portions of HIA 200. At least a portion of the pressure compensation annulus 275 may thus be utilized for pressure compensation of wellbore fluid and/or internal fluid contained within the HIA 200.

Figure 3:
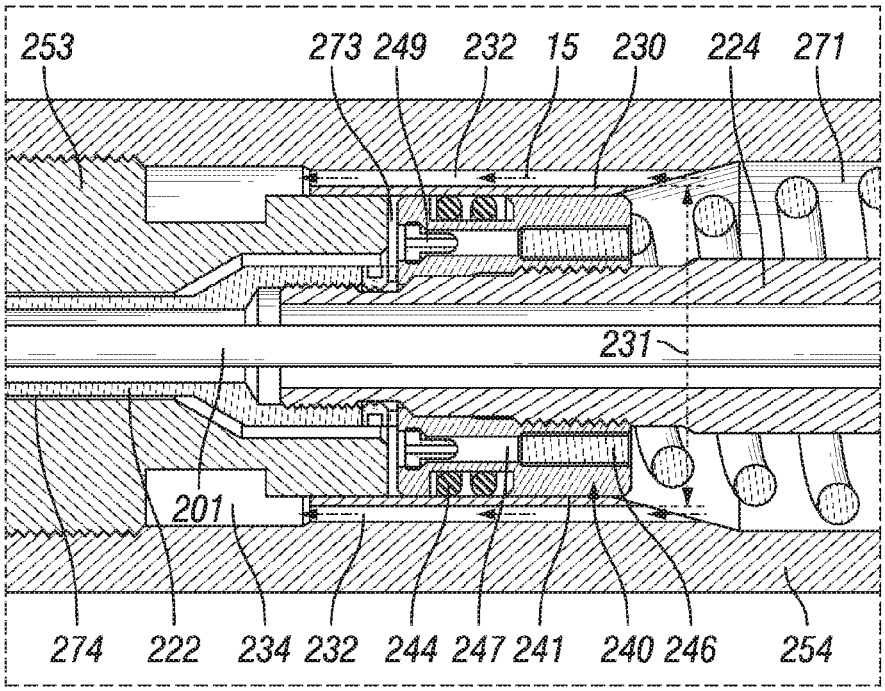
FIG. 3 is an enlarged sectional view of a portion of the apparatus shown in FIG. 2 according to one or more aspects of the present disclosure

FIG. 3 is an enlarged view of a portion of the apparatus shown in FIG. 2. Referring to FIGS. 2 and 3 collectively, the HIA 200 comprises a piston 240 fixedly positioned about the intermediate mandrel 224 and sealingly engaging the shoulder 230 of the intermediate housing 254. The piston 240 may by fixedly coupled to the intermediate mandrel 224 via threaded engagement. However, the piston 240 may instead be integrally formed with the intermediate mandrel 224 or fixedly coupled to the intermediate mandrel 224 by other means, including, but not limited to, adhesive, set screw(s), and/or retaining ring(s).

The piston 240 may be operable to prevent fluid communication between the piston 240 and the intermediate mandrel 224. The piston 240 may also comprise an outer surface 241 operable for sealingly engaging the shoulder 230, such as may reduce or prevent fluid communication between the lower annulus 271 and the intermediate annulus 273. For example, the outer surface 241 may comprise an outer finish that is sufficiently smooth to form a metal-to-metal seal against the shoulder 230. The piston 240 may also comprise an O-ring and/or other fluid-sealing element 244, such as may reduce or prevent fluid communication between the shoulder 230 and the piston 240.

The piston 240 may also comprise one or more check valves 246 disposed within one or more longitudinal bores 247 extending through the piston 240. The check valves 246 may be operable to allow fluid communication through the bores 247 in the downhole direction 102, from the intermediate annulus 273 to the lower annulus 271, and to prevent fluid flow from the lower annulus 271 to the intermediate annulus 273. Each longitudinal bore 247 may also comprise a filter 249 disposed therein and operable to prevent contaminants from flowing through and potentially impairing the function of the check valves 246. The intermediate annulus 273 may be defined by the space formed between the intermediate connector 253 and the piston 240, wherein the intermediate annulus 273 increases in volume as the housing assembly 250 and the mandrel assembly 220 move apart from each other (e.g., as the housing assembly 250 moves in the uphole direction 101 with respect to the mandrel assembly 220). The intermediate annulus 273 may be fluidly connected with the upper annulus 272 via an annular passageway 274 extending between the intermediate connector 253 and the upper mandrel 222. During operations, as the housing assembly 250 moves with respect to the piston 240 and the mandrel assembly 220, internal fluid may flow between the upper annulus 272 and the intermediate annulus 273 through the annular passageway 274.

The HIA 200 may further comprise a biasing member 248 positioned within the lower annulus 271 and operable to urge the housing assembly 250 and the mandrel assembly 220 toward a first position, in which the piston 240 is positioned within the shoulder 230 and against the intermediate connector 253. For example, FIG. 2 depicts the biasing member 248 as being or comprising a spring urging the piston 240 and the lower housing connector 255 away from each other such that the piston 240 is positioned within the shoulder 230 and against the intermediate connector 253.

As described above, the intermediate housing 254 may comprise a shoulder 230 protruding radially inward from and/or relative to an internal surface of the intermediate housing 254. The intermediate housing 254 may also comprise one or more fluid channels 232 extending longitudinally through a portion of the intermediate housing 254 from the upper side of the shoulder 230 to the lower side of the shoulder 230. The upper end of the shoulder 230 may fluidly seal against the lower end of the upper housing connector 253 to define an annular channel 234 extending circumferentially between the shoulder 230 and the upper housing connector 253, wherein the upper end of the fluid channels 232 may fluidly connect with the annular channel 234.

Figure 4:
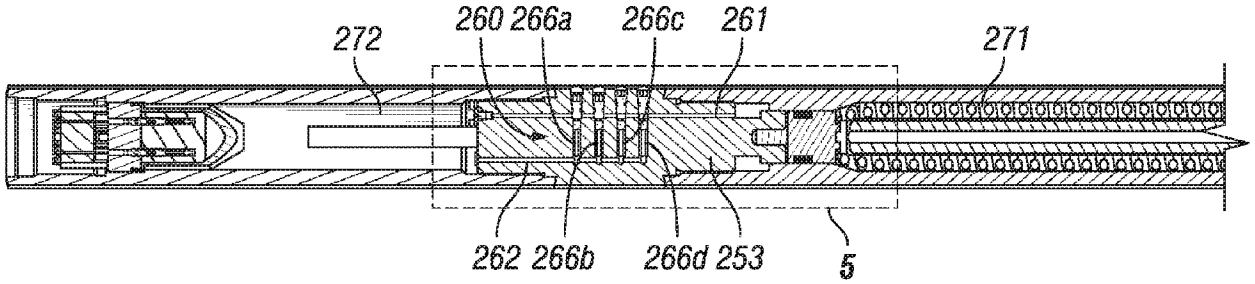
FIG. 4 is a sectional view of an example implementation of a portion of the apparatus shown in FIG. 1 according to one or more aspects of the present disclosure.
Figure 5:
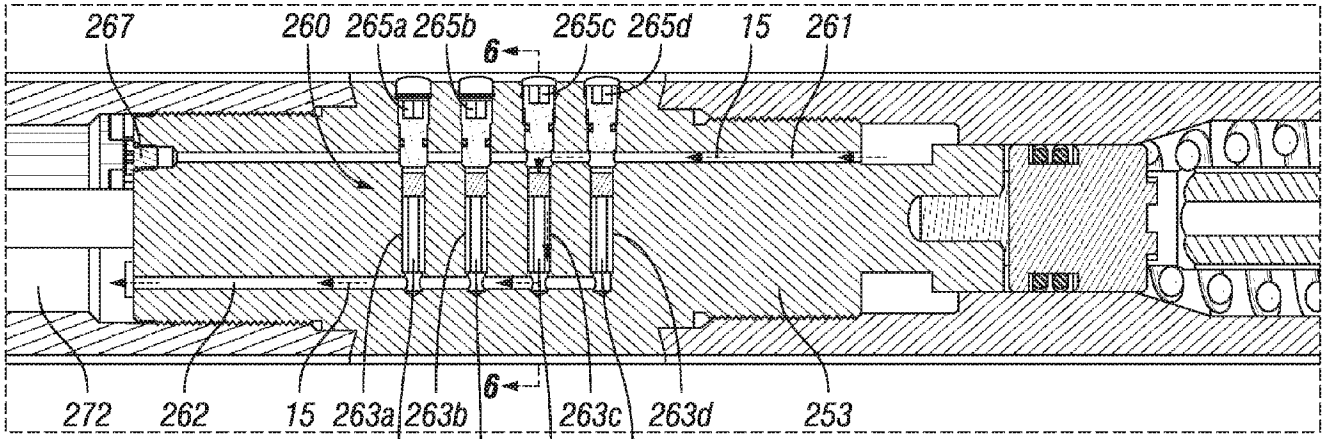
FIG. 5 is an enlarged sectional view of a portion of the apparatus shown in FIG. 4 according to one or more aspects of the present disclosure

FIG. 4 is a sectional view of a portion of the HIA 200 shown in FIG. 1. FIG. 5 is an enlarged portion of FIG. 4 that depicts the piston 240, the shoulder 230, the upper housing connector 253, and a pressure relief assembly 260 according to one or more aspects of the present disclosure. Collectively, FIGS. 4 and 5 depict the pressure relief assembly 260 positioned within the upper housing connector 253. The pressure relief assembly 260 may control fluid flow from the lower annulus 271 to the upper annulus 272 based on a pressure of the internal fluid in the lower annulus 271 relative to a set, cracking, or relief pressure (hereafter collectively referred to as "set pressure") of the pressure relief assembly 260. The pressure relief assembly 260 may comprise multiple pressure relief valves 266*a-d* operable to prevent communication or relief of internal fluid from the lower annulus 271 to the upper annulus 272 until a set pressure of one or more pressure relief valves 266*a-d* is exceeded. For example, when the pressure in the lower annulus 271 exceeds the set pressure of at least one of the pressure relief valves 266*a-d*, the pressure relief assembly 260 may allow fluid communication therethrough.

Figure 6:
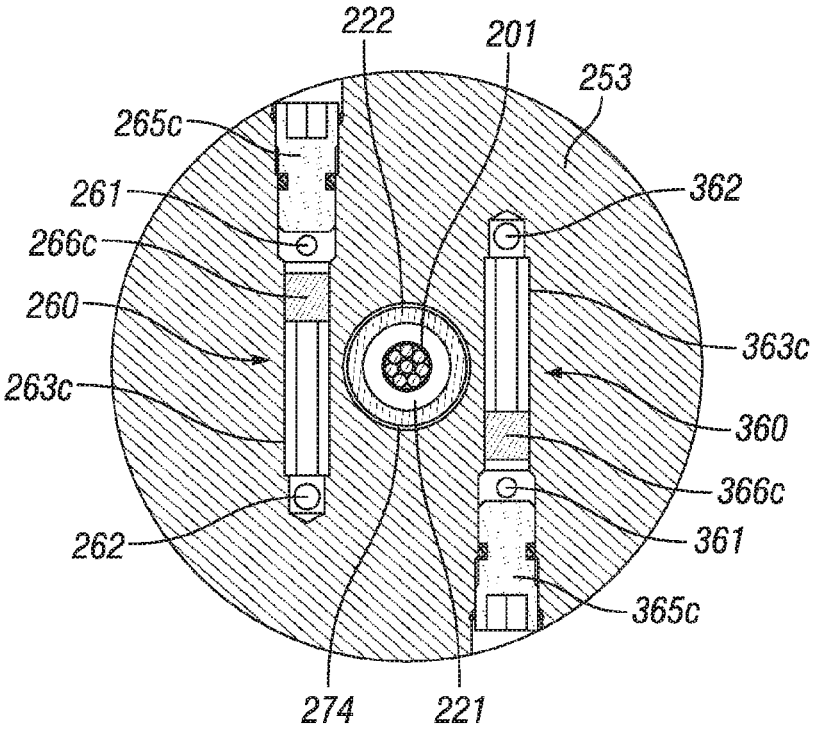
FIG. 6 is a sectional view of an example implementation of a portion of the apparatus shown in FIGS. 5 and 12 according to one or more aspects of the present disclosure.

FIG. 6 is a sectional view of a portion of the HIA 200 shown in FIG. 5 according to one or more aspects of the present disclosure. Referring to FIGS. 4-6. collectively, the pressure relief assembly 260 may comprise multiple pressure relief valves 266*a-d* positioned within corresponding cavities 263*a-d* extending into the upper housing connector 253. The cavities 263*a-d* may extend from the exterior surface of the upper housing connector 253 and into the internal portion thereof, without intercepting the annular passageway 274. The cavities 263*a-d* may also be fluidly coupled in parallel between the lower annulus 271 and the upper annulus 272. The cavities 263*a-d* may extend between a first fluid channel 261 and a second fluid channel 262, wherein the fluid channels 261, 262 may extend longitudinally through the upper housing connector 253. The first fluid channel 261 may fluidly connect the annular channel 234 with the cavities 263*a-d* at an intermediate point along the cavities 263*a-d*, which may be between the outer openings and the inner bottoms of the cavities 263*a-d*. The upper end of the first fluid channel 361 may comprise a plug 267 to prevent internal fluid from communicating into the upper annulus 272. The second fluid channel 262 may fluidly connect the cavities 263*a-d* with the upper annulus 272 at the inner bottoms of the cavities 263*a-d*. Each of the cavities 263*a-d* may be operable to receive a threaded plug 265*a-d* therein, wherein each cavity 263*a-d* may comprise a threaded portion for receiving a threaded plug 265*a-d* therein. The plugs 265*a-d* may be translated (e.g., screwed in or out) along the cavities 263*a-d* to block or unblock (i.e., prevent or allow) fluid communication between the first fluid channel 261 and each of the corresponding cavities 263*a-d*.

For example, if the fourth plug 265*d* is translated away from the first channel 261, the internal fluid may communicate into the fourth cavity 263*d* and, therefore, communicate with the fourth relief valve 266*d*. Likewise, if the third plug 265*c* is translated away from the first channel 261 and the fourth plug 265*d* is also translated away from the first channel 261, the internal fluid may communicate into the third cavity 263*c* and, therefore, communicate with the third relief valve 266*c*. Also, if the second plug 265*b* is translated away from the first channel 261 and the third and fourth plugs 265*c*, 265*d* are also translated away from the first channel 261, the internal fluid may communicate into the second cavity 263*b* and, therefore, communicate with the second relief valve 266*b*. If the first plug 265*a* is translated away from the first channel 261 and the second, third, and fourth plugs 265*b*, 265*c*, 265*d* are also translated away from the first channel 261, the internal fluid may communicate into the first cavity 263*a* and, therefore, communicate with the first relief valve 266*a*.

Each pressure relief valve 266*a-d* may be or comprise a cartridge type pressure relief valve that may be insertable into the cavities 263*a-d*. Each pressure relief valve 266*a-d* may comprise a different set pressure to allow internal fluid to communicate or relieve through each cavity 263*a-d* at different predetermined pressures. Such configuration may allow the pressure relief assembly 260 to allow internal fluid to communicate or relieve through the pressure relief assembly 260 from the lower annulus 271 to the upper annulus 272 at different predetermined pressures, allowing the set pressure to be adjusted without removing the pressure relief assembly 260 or the individual pressure relief valves 266*a-d* from the HIA 200. Since each plug 265*a-d* may prevent fluid communication into a blocked cavity and any other cavity located downstream (i.e., in the uphole direction 101) along the first channel 261, the relief valves 266*a-d* may be inserted into the cavities 263*a-d* in order of increasing set pressure, wherein the first pressure relief valve 266*a* comprises a lowest set pressure and the fourth pressure relief valve 266*d* comprises a highest set pressure.

For example, the first pressure relief valve 266*a* may comprise a set pressure of about 500 pounds per square inch (psi), the second pressure relief valve 266*b* may comprise a set pressure of about 1000 psi, the third pressure relief valve 266*c* may comprise a set pressure of about 2000 psi, and the fourth pressure relief valve 266*d* may comprise a set pressure of about 3000 psi. Accordingly, the effective set pressure may be selected from 500 psi intervals within a range of 500 psi to 6500 psi (500+1000+2000+3000=6500). However, other set pressures, intervals, and ranges are also within the scope of the present disclosure.

Instead of the pressure relief valves 266*a-d*, the cavities 263*a-d* may receive therein burst disks, hydraulic fuses, and/or other types of pressure relief devices known in the art. Although FIGS. 4 and 5 show the pressure relief assembly 260 comprising four sets of cavities 263*a-d*, pressure relief valves 266*a-d*, and plugs 265*a-d*, it should be understood that the pressure relief valve 260 may comprise two, three, five, or more sets of cavities, pressure relief valves, and plugs, which may comprise the same or similar structure and/or function as described herein.

Figure 7:
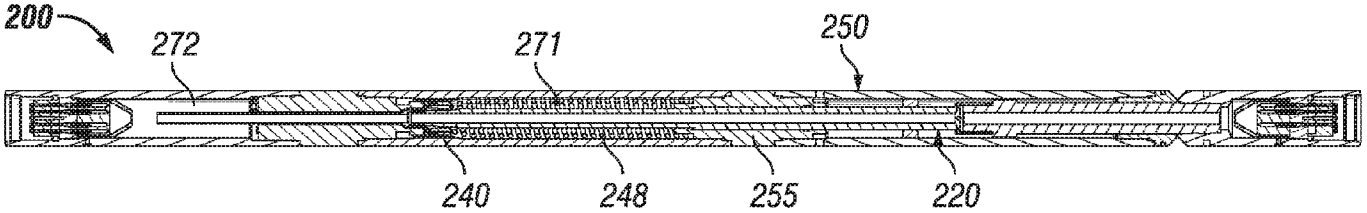
FIGS. 7, 8, and 9 are sectional views of the example implementation shown in FIG. 2 in various stages of operation according to one or more aspects of the present disclosure.
Figure 8:
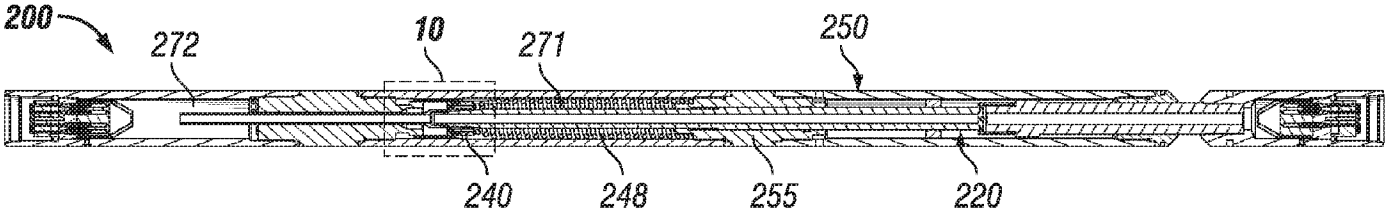
Figure 9:
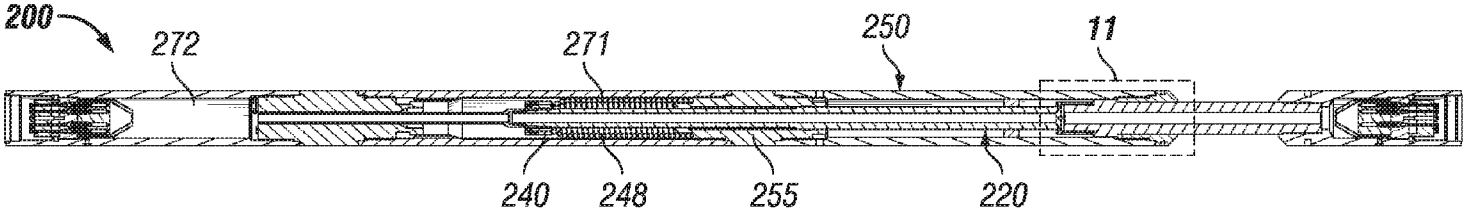

FIGS. 7, 8, and 9 are sectional views of the HIA 200 shown in FIG. 1 in various stages of operation according to one or more aspects of the present disclosure. Referring to FIGS. 1, 4, and 7-9, collectively, the housing assembly 250 is movable with respect to the mandrel assembly 220 between the first or a latched position, shown in FIG. 7, a second or release position, shown in FIG. 8, and a third or impact position, shown in FIG. 9. During operations, when a component of the second portion 150 of the tool string 110 becomes stuck, such that it is desired to deliver an impact to the second portion 150 of the tool string 110 in the uphole direction 101, a tension load may be applied to the HIA 200 while the HIA 200 is in the latched position (FIG. 7), in which the housing assembly 250 and the mandrel assembly 220 are retracted and latched together. When tension is applied to the HIA 200, pressure increases within the lower annulus 271 as the internal fluid is sealed therein by the piston 240 and the lower housing connector 255 to prevent the housing assembly 250 from moving with respect to the mandrel assembly 220. The pressure relief assembly 260 may also prevent the internal fluid from communicating from the lower annulus 271 into the upper annulus 272. For example, as depicted in FIGS. 3 and 5, the pressure relief valves 266*a-d* may block the internal fluid from communicating from the lower annulus 271 into the upper annulus 272 through an internal fluid passageway system comprising the fluid channels 232, 234, 261, 262 and the cavities 263*a-d*, which collectively extend between the lower annulus 271 and the upper annulus 272.

When sufficient tension is applied to the HIA 200, fluid pressure within the lower annulus 271 may exceed the set pressure of the pressure relief assembly 260, thus allowing internal fluid to escape or communicate through the pressure relief assembly 260. Therefore, the pressure relief assembly 260 may be set to allow internal fluid to escape from the lower annulus 271 at a desired pressure, which may correspond to a tension load that is believed to be sufficient or necessary to free the stuck tool string. Thus, when the set pressure in the lower annulus 271 is reached, at least one of the pressure relief valves 266*a-d* may shift open to allow fluid communication through a corresponding cavity 263*a-d* to, therefore, allow the housing assembly 250 to move with respect to the stationary mandrel assembly 220.

Figure 10:
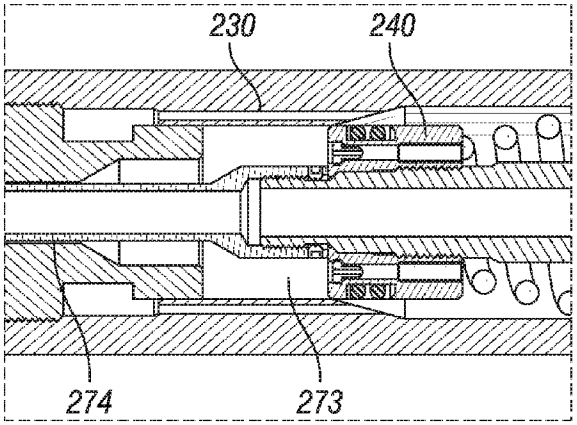
FIG. 10 is an enlarged sectional view of a portion of the apparatus shown in FIG. 8 according to one or more aspects of the present disclosure.

As depicted in FIGS. 3 and 5 collectively, the internal fluid may first flow from the upper annulus 271 into and through the fluid channel 232, as indicated by the arrows 15. The internal fluid may then flow into the annular channel 234 between the shoulder 230 and the upper housing connector 253. Thereafter, the internal fluid may flow into the first fluid channel 261 and into one or more of the cavities 263*a-d* to bypass one or more cracked or opened pressure relief valves 266*a-d*. Once the internal fluid bypasses the pressure relief valves 266*a-d*, the internal fluid may relieve or communicate into the upper annulus 272 through the second fluid channel 262. For example, FIG. 5 depicts the third and fourth plugs 265*c*, 265*d* translated away from the first fluid channel 261, to allow the third relief valve 263*c* to open and allow internal fluid to communicate through the third cavity 263*c*. Because of the restrictive nature of the fluid channels 232, 234, 261, and 262 and the pressure relief valves 266*a-d*, the internal fluid may be metered as it passes from the lower annulus 271 to the upper annulus 272, slowing the movement of the housing assembly 250 with respect to the mandrel assembly 220. The resulting fluid metering may create a time delay from when the housing assembly 250 starts to move until the time when the shoulder 230 moves past the piston 240, as depicted in FIGS. 8 and 10, wherein FIG. 10 depicts an enlarged portion of the HIA 200 shown in FIG. 8. Another flow control valve, such as a metering valve (not shown), may be positioned along one of the fluid channels 232, 234, 261, and 262 to further control the rate of fluid flow therethrough if additional time delay or fluid metering is desired.

Referring to FIGS. 1 and 8-10, collectively, as the internal fluid communicates out of the lower annulus 271, the housing assembly 250 moves in the uphole direction 101 as the mandrel assembly 220 remains essentially static, being attached to the second portion 150 of the tool string 110 that is stuck in the wellbore 120. As the upper housing connector 253 moves away from the piston 240, the intermediate annulus 273 increases in volume as the internal fluid moves therein from the upper annulus 272 through the annular passageway 274. When the shoulder 230 moves past the piston 240, the annular space between the piston 240 and the intermediate housing 254 opens significantly, allowing the internal fluid to bypass the piston 240 and move from the lower annulus 271 to the intermediate annulus 273 at a substantially higher flow rate. Therefore, when the shoulder 230 moves past the piston 240, the housing assembly 250 may move essentially freely with respect to the mandrel assembly 220.

Figure 11:
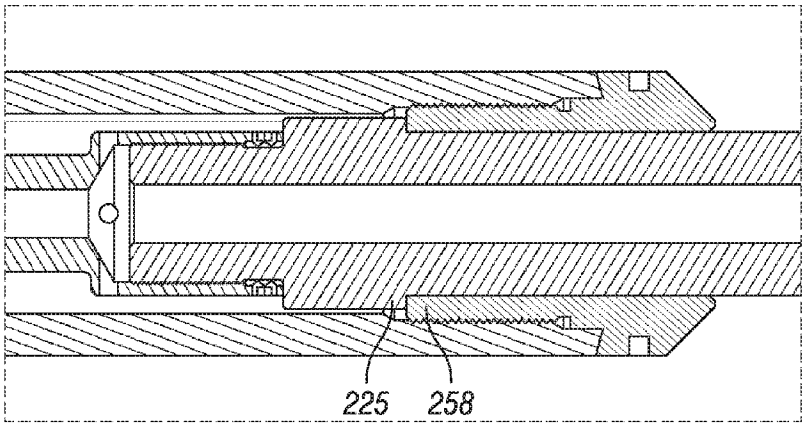
FIG. 11 is an enlarged sectional view of a portion of the apparatus shown in FIG. 9 according to one or more aspects of the present disclosure.

The tool string 110 and/or the conveyance means 160 may then contract, accelerating the housing 250 in the uphole direction 101 until the piston 240 and the shoulder 230 move sufficiently far apart and the second impact feature 258 impacts the first impact feature 225, thus creating an impact intended to free the second portion 150 of the tool string 110. The impact between the second impact feature 258 and the first impact feature 225 is depicted in FIGS. 9 and 11, wherein FIG. 11 depicts an enlarged portion of the HIA 200 shown in FIG. 9. The higher the tension force applied to the HIA 200, which may be proportional to the set pressure of the pressure relief assembly 260, the faster the acceleration of the housing assembly 250, and the greater the impact force generated by the first and second impact shoulders 225, 258.

FIGS. 7, 8, and 9 further show that, during operations, the biasing member 248 is compressed as the housing assembly 250 moves with respect to the mandrel assembly 220. After the impact between the first and second impact shoulders 225, 258, the biasing spring 248 urges or pushes the piston 240 and the lower housing connector 255 away from each other to urge the housing assembly 250 and the mandrel assembly 220 toward the first position, thus resetting the HIA 200 to deliver another impact. As the shoulder 230 moves in the downhole direction 102 about the piston 240, the internal fluid may communicate from the intermediate annulus 273 into the lower annulus 271 through the one or more check valves 246 disposed in the one or more longitudinal bores 247 of the piston 240, as shown in FIG. 3. The ability to reset the HIA 200 using the biasing member 248 may be beneficial when, for example, external compression forces are not available or are insufficient to move the housing assembly 250 and the mandrel assembly 220 to the first position.

Figure 12:
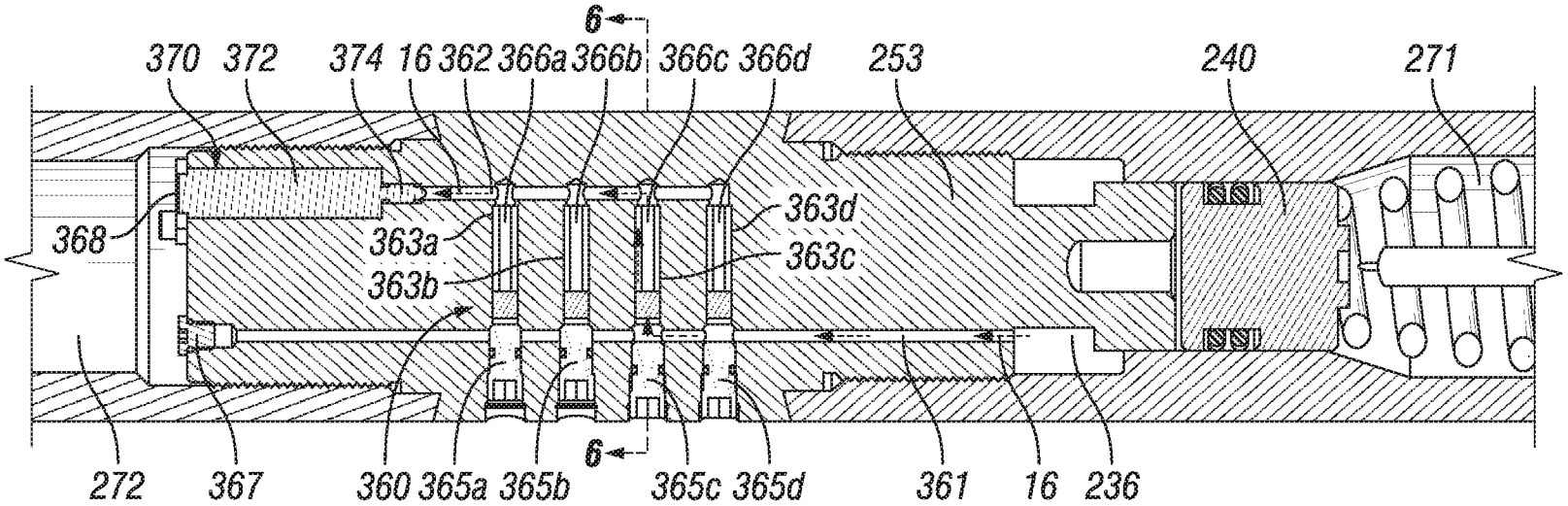
FIG. 12 is a sectional view of an example implementation of a portion of the apparatus shown in FIG. 1 according to one or more aspects of the present disclosure.

FIG. 12 is a sectional view of at least a portion of an example implementation of the HIA 200 shown in FIG. 1 according to one or more aspects of the present disclosure. In particular, instead of or in addition to the pressure relief assembly 260, the HIA 200 may comprise a pressure relief assembly 360, operable to allow fluid communication from the lower annulus 271 to the upper annulus 272 at a predetermined set relief pressures. Referring to FIGS. 6 and 12, collectively, the pressure relief assembly 360 may comprise multiple pressure relief valves 366*a-d* positioned within corresponding cavities 363*a-d* extending into the upper housing connector 253. The cavities 363*a-d* may extend from the exterior surface of the upper housing connector 253 and into the internal portion thereof, without intercepting the annular passageway 274. The cavities 363*a-d* may also be fluidly coupled in parallel between the lower annulus 271 and the upper annulus 272. In particular, the cavities 363*a-d* may extend between a first fluid channel 361 and a second fluid channel 362, wherein the fluid channels 361, 362 extend longitudinally through the upper housing connector 253. The first fluid channel 361 may fluidly connect the annular channel 234 and the cavities 363*a-d* at an intermediate point along the cavities 363*a-d* between the outer openings and the inner bottoms of the cavities 363*a-d*. The upper end of the first fluid channel 361 may comprise a plug 367 to prevent internal fluid from communicating into the upper annulus 272. The second fluid channel 362 may fluidly connect the upper annulus 272 and the cavities 363*a-d* at the inner bottoms of the cavities 363*a-d*. Each of the cavities 363*a-d* may be operable to receive a threaded plug 365*a-d* therein, wherein each cavity 363*a-d* may comprise a threaded portion for receiving a threaded plug 365*a-d* therein. The plugs 365*a-d* may be translated along the cavities 363*a-d* to block or unblock fluid communication between the first channel 361 and each of the corresponding cavities 363*a-d*.

For example, if the fourth plug 365*d* is translated away from the first channel 361, the internal fluid may communicate into the fourth cavity 363*d* and, therefore, communicate with the fourth relief valve 366*d*. Likewise, if the third plug 365*c* is translated away from the first channel 361 and the fourth plug 365*d* is also translated away from the first channel 361, the internal fluid may communicate into the third cavity 363*c* and, therefore, communicate with the third relief valve 366*c*. Also, if the second plug 365*b* is translated away from the first channel 361 and the third and fourth plugs 365*c*, 365*d* are also translated away from the first channel 361, the internal fluid may communicate into the second cavity 363*b* and, therefore, communicate with the second relief valve 366*b*. If the first plug 365*a* is translated away from the first channel 361 and the second, third, and fourth plugs 365*b*, 365*c*, 365*d* are also translated away from the first channel 361, the internal fluid may communicate into the first cavity 363*a* and, therefore, communicate with the first relief valve 366*a*.

Each pressure relief valve 366*a-d* may be or comprise a cartridge type pressure relief valve that may be insertable into cavities 363*a-d*. Each pressure relief valve 366*a-d* may comprise a different set pressure to allow internal fluid to communicate or relieve through each cavity 363*a-d* at different predetermined pressures. Such configuration may allow the pressure relief assembly 360 to allow internal fluid to communicate or relieve through the pressure relief assembly 360 from the lower annulus 271 to the upper annulus 272 at different predetermined pressures. Since each plug 365*a-d* may prevent internal fluid communication into the blocked cavity and any other cavity located downstream (e.g., in the uphole direction 101), along the first channel 361, the relief valves 366*a-d* may be inserted into the cavities 363*a-d* in order of increasing set pressure, wherein the first pressure relief valve 366*a* comprises the lowest set pressure and the fourth pressure relief valve 366*d* comprises the highest set pressure.

The pressure relief valves 366*a-d* may comprise set relief pressures that are the same or similar to set pressures of the pressure relief valves 266*a-d* of the pressure relief assembly 260. Alternatively, the pressure relief valves 366*a-d* may comprise set pressures that are higher than the set pressures of the pressure relief valves of 266*a-d*. For example, the first pressure relief valve 366*a* may comprise a set pressure of about 3500 psi, the second pressure relief valve 366*b* may comprise a set pressure of about 4000 psi, the third pressure relief valve 366*c* may comprise a set pressure of about 5000 psi, and the fourth pressure relief valve 366*d* may comprise a set pressure of about 6000 psi. Accordingly, the effective set pressure may be selected from various values within a range of 3500 psi to 18,500 psi (3500+4000+5000+6000=6500). However, other set pressures, intervals, and ranges are also within the scope of the present disclosure.

In still another example implementation of the HIA 200, instead of the pressure relief valves 366*a-d*, the cavities 363*a-d* may receive therein burst disks, hydraulic fuses, and/or other types of pressure relief devices (not shown) known in the art. Although FIG. 12 shows the pressure relief assembly 360 comprising four sets of cavities 363*a-d*, pressure relief valves 366*a-d*, and plugs 365*a-d*, it should be understood that the pressure relief valve 360 may comprise two, three, five, or more sets of cavities, pressure relief valves, and plugs, which can function or interact in the same or similar manner as described herein.

The general structure and function of the pressure relief assembly 360 may be the same or similar to that of the pressure relief assembly 260 described above. However, the pressure relief assembly 360 may further comprise a flow control and/or shut-off valve 370 disposed along the second fluid channel 362, such as to selectively prevent internal fluid from communicating from the lower annulus 271 to the upper annulus 272. For example, FIG. 12 depicts a solenoid operated shut-off valve 370 positioned along the second fluid channel 362 between the first cavity 363*a* and the upper annulus 272. The shut-off valve 370 may comprise a blocking portion 374 operable for blocking fluid flow through the second fluid channel 362, wherein the blocking portion 374 may be selectively actuated by a solenoid 372 to shift between an open-flow position (i.e., allowing fluid flow therethrough) and a closed-flow position (i.e., not allowing fluid flow therethrough). When shifted to the open-flow position, the blocking portion 374 allows internal fluid to communicate through the second flow channel 362 into the upper annulus 272. The solenoid may be positioned in a cavity 364 extending into the upper housing connector 253 and retained therein by a solenoid retainer plate 368.

During operations, the pressure relief assembly 360 may allow internal fluid to communicate from the lower annulus 271 to the upper annulus 272 if the pressure in the lower annulus 271 exceeds the set pressure of one or more pressure relief valves 366*a-d* that are exposed to the first fluid channel 361 and if the shut-off valve 370 is shifted to the open-flow position. Therefore, although the pressure in the lower annulus 271 may exceed the set pressure of one or more of the pressure relief valves 366*a-d*, internal fluid may not communicate from the lower annulus 271 to the upper annulus 272 through the fluid passageway system comprising the fluid channels 232, 234, 361, 362 and the cavities 363*a-d*, until the shut-off valve 370 is shifted to the open-flow position. Alternatively, instead of the shut-off valve 370, the HIA 200 may comprise a different flow control valve to remotely control fluid communication out of the lower annulus 271, including pilot-operated valves, cartridge valves, poppet valves, plunger valves, diaphragm valves, and/or other examples of flow control devices known in the art.

The shut-off valve 370 may comprise a normally closed configuration, wherein the shut-off valve 370 may be operable to remain in the closed-flow position when not actuated by the solenoid 372 and shift to the open-flow position when actuated by the solenoid 372. The shut-off valve 370 may be operable to detect an electrical characteristic of the electrical conductor 201 to actuate the blocking portion 374 to the open-flow position to allow fluid communication through the pressure relief assembly 360 when the pressure in the lower annulus exceeds the set pressure of at least one of the pressure relief valves 366*a-d*. When the electrical characteristic is not present, the blocking member 374 of the shut-off valve 370 does not allow fluid communication through the second fluid channel 362 and, therefore, does not allow fluid communication through the pressure relief assembly 360 even when the pressure in the lower annulus exceeds the set pressure of at least one pressure relief valve 366*a-d*.

The electrical characteristic detected by the shut-off valve 370 may be a substantially non-zero voltage and/or current, such as in implementations in which the electrical characteristic is a voltage substantially greater than about 0.01 volts and/or a current substantially greater than about 0.001 amperes. For example, the electrical characteristic may be a voltage substantially greater than about 0.1 volts and/or a current substantially greater than about 0.01 amperes. However, other values are also within the scope of the present disclosure. Alternatively, the solenoid 372 of the shut-off valve 370 may receive an electrical characteristic from another source, including, for example, another electrical conductor (not shown) extending between the surface and the HIA 200 or a battery (not shown) located within the HIA 200.

During operations of the HIA 200, the pressure relief assembly 360 may be operable to set additional relief pressures. For example, referring to FIGS. 5 and 12, if the desired pressure at which to create an impact is 5000 psi, plugs 265*a-d* of the pressure relief assembly 260 may be translated (not shown) to fluidly isolate (e.g., plug off) the cavities 263*a-d* from the first channel 261. However, since the fourth plug 265*d* fluidly isolates the cavities 263*a-d* from the first fluid channel 261, it may only be necessary to translate the fourth plug 265*d* to also isolate the remaining cavities 263*a-d*. Thereafter, plugs 365*a*, 365*b* of the pressure relief assembly 360 may be translated to fluidly isolate the first and second cavities 363*a*, 363*b* from the first channel 361. However, since the second plug fluidly isolates cavities 363*a*, 363*b* from the first fluid channel 361, it may only be necessary to translate the second plug 365*b* to also isolate the first cavity 363*a*. The third and fourth plugs 365*c*, 365*d* may be translated away from the first fluid channel 361 to allow fluid communication with the third cavity 363*c* and the third pressure relief valve 366*c*. At this point the HIA 200 is configured to allow internal fluid from the lower annulus 271 to communicate with the third and the fourth pressure relief valves 366*c*, 366*d*. When the fluid pressure in the lower relief annulus 271 exceeds 5000 psi, the third pressure relief valve 366*d* may shift to allow internal fluid to communicate through the third cavity 363*c* and, therefore, the second fluid channel 362, as indicated by the arrows 16. It should be noted that internal fluid will be allowed to communicate through the third cavity 363*c* only if the shut-off valve is in the open-flow position.

Alternatively, both pressure relief assemblies 260, 360 may be utilized simultaneously. For example, the pressure relief assembly 360 may be operable to set a desired pressure at which the HIA 200 creates an impact, while the pressure relief assembly 260 may be operable for safety or fail-safe purposes. In this configuration, for example, the pressure relief valves 366*a-d* of the pressure relief assembly 360 may comprise set pressures of 500 psi, 1000 psi, 2000 psi, and 3000 psi, respectively, while the pressure relief valves 266*a-d* of the pressure relief assembly 260 may comprise set pressures of 3500 psi, 4000 psi, 5000 psi, and 6000 psi, respectively. The pressure relief assembly 260 may relieve internal fluid from the lower annulus 271 to the upper annulus 272 when the pressure in the lower annulus 271 reaches a predetermined set pressure of the pressure relief assembly 260, if the internal fluid in the lower annulus 271 did not first relieve through pressure relief assembly 360 at its predetermined set pressure, which is lower than the set pressure of the pressure relief assembly 260. The pressure relief assembly 360 may not relieve internal fluid at the set pressure if, for example, the shut-off valve is not actuated to the open-flow position or one or more of the pressure relief valves 366*a-d* are stuck in the closed-flow position.

Alternatively, the pressure relief assembly 360 may be operable to remotely trigger the HIA 200 to create an impact. For example, if the pressure relief valve 360 is set to relieve internal fluid at 1000 psi, the shut-off valve may be operable to trigger the impact at any time after the pressure in the lower annulus 271 exceeds 1000 psi. Therefore, the electrical conductor 201 may actuate the shut-off valve 370 to the open-flow position at, for example, 1500 psi, to relieve the internal fluid in the lower annulus 271 to the upper annulus 272 to cause the housing assembly 250 to move with respect to the mandrel assembly 220 and, therefore, trigger the impact. Also, the electrical conductor 201 may continuously actuate the shut-off valve 370 to the open-flow position, in which case the internal fluid in the lower annulus 271 may relieve to the upper annulus 272 as soon as the fluid pressure in the lower annulus 271 exceeds the set pressure of the pressure relief assembly 360.

Figure 13:
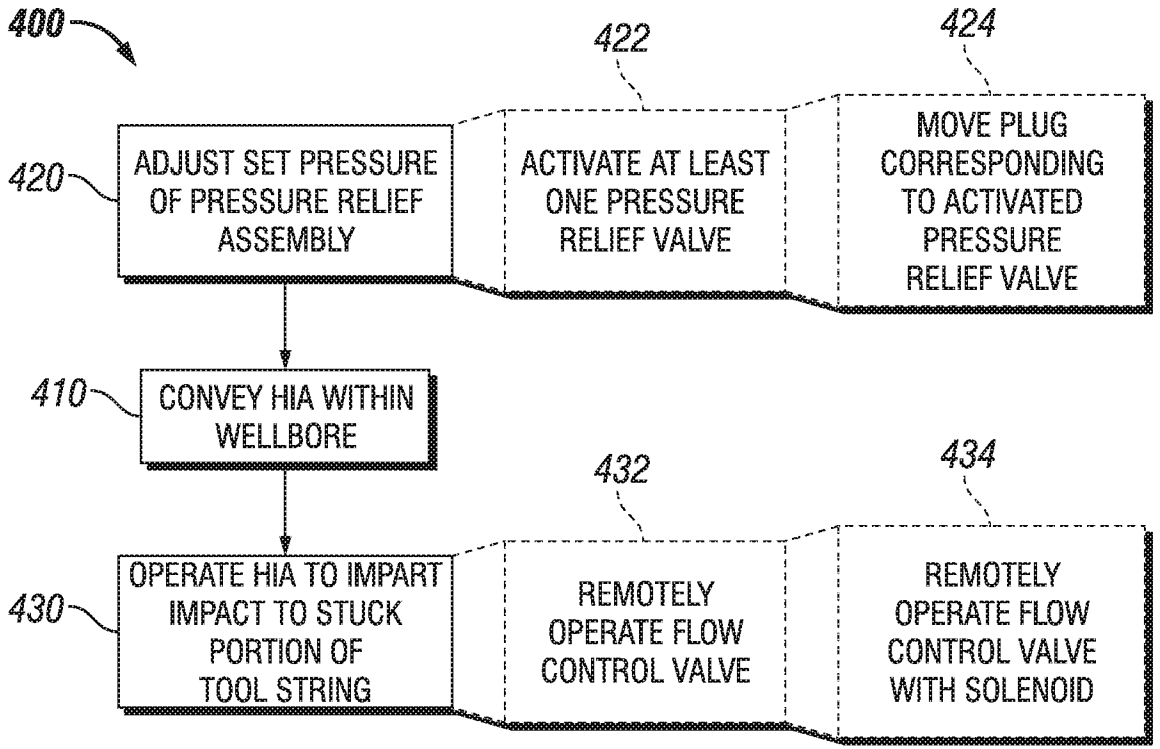
FIG. 13 is a flow-chart diagram of at least a portion of a method according to one or more aspects of the present disclosure.

FIG. 13 is a flow-chart diagram of at least a portion of an example implementation of a method (400) of operation utilizing the HIA 200 according to one or more aspects of the present disclosure, such as in the example operating environment depicted in FIG. 1, among others within the scope of the present disclosure. Referring to FIGS. 1-3, 5, 7-9, 12, and 13, collectively, the method (400) may comprise conveying (410) the HIA 200 within the wellbore 120 in a downhole direction 102 with the HIA 200 coupled between the first portion 140 and the second portion 150 of the tool string 110, whether as part of the tool string 110 before the tool string 110 gets stuck, or after the tool string 110 is already stuck in the wellbore 120. During the conveying (410), the HIA 200 may be in the configuration shown in FIGS. 2 and 7, in which the HIA 200 is in the first or reset position. The method (400) may further comprise operating (430) the HIA 200 to impart an impact to the second portion 150 of the tool string 110.

The method (400) may further comprise adjusting (420) one or more set pressures of the pressure relief assembly 260, 360 prior to conveying the tool string 110 within the wellbore 120. As described above, the pressure relief assembly 260, 360 comprises multiple individually activated pressure relief valves 266*a-d*, 366*a-d*. Therefore, adjusting (420) the set relief pressure of the pressure relief assembly 260, 360 may comprise activating (422) at least one of a plurality of pressure relief valves 266*a-d*, 366*a-d*.

As described above, the pressure relief assembly 260, 360 may further comprise a plurality of plugs 265*a-d*, 365*a-d*, each operable with a corresponding one of the plurality of pressure relief valves 266*a-d*, 366*a-d*. Hence, activating (422) at least one of the plurality of pressure relief valves 266*a-d*, 366*a-d* may comprise moving (424) a corresponding one of the plurality of plugs 265*a-d*, 365*a-d* to permit fluid communication between the lower and upper annulus portions 271, 272 via the at least one activated pressure relief valve 266*a-d*, 366*a-d*.

As described above, the HIA 200 may further comprise a flow control valve or a shut-off valve 370, wherein operating the HIA 200 comprises remotely operating (432) the shut-off valve 370 to permit fluid communication through the pressure relief assembly 360 after a predetermined tension is applied to the HIA 200. Remotely operating (432) the shut-off valve 370 may comprise remotely operating (434) the shut-off valve with a solenoid 372 to permit fluid communication through the pressure relief assembly 360 after a predetermined tension is applied to the HIA 200.

In view of the entirety of the present disclosure, including the figures and the claims, a person having ordinary skill in the art will readily appreciate that the present disclosure introduces an apparatus comprising: a hydraulic jar coupled between opposing first and second portions of a downhole tool string, wherein the hydraulic jar comprises: a housing comprising a shoulder protruding radially inward from an internal surface of the housing; a shaft disposed within the housing, wherein the housing and the shaft move axially relative to each other, and wherein the shoulder axially interposes first and second portions of an annulus formed between the shaft and the housing; a piston fixedly positioned about the shaft and fluidly sealed against the shoulder; and a pressure relief device controlling fluid flow from the first annulus portion to the second annulus portion based on a pressure of the fluid in the first annulus portion relative to a set pressure of the pressure relief device.

The housing may be substantially tubular.

The fluid may be hydraulic oil.

The axially relative movement of the housing and the shaft may be between: a first position in which the piston fluidly seals against the shoulder; and a second position in which the piston is longitudinally offset from the shoulder, thus permitting the fluid to flow from the first annulus portion to the second annulus portion via a third annulus portion between the shoulder and the shaft. When the housing and the shaft are in the first position, the piston may prevent fluid flow through the third annulus portion. When the pressure in the first annulus portion exceeds the set pressure of the pressure relief device, the fluid may be communicated from the first annulus portion to the second annulus portion via the pressure relief device. The housing and the shaft may move away from the first position and toward the second position in response to the fluid being communicated from the first annulus portion to the second annulus portion via the pressure relief device. The shaft may comprise a first impact feature, the housing may comprise a second impact feature, and the first and second impact features may impact when the housing and the shaft are in the second position.

The pressure relief device may comprise a plurality of pressure relief valves each selectable to relieve the fluid from the first annulus portion to the second annulus portion. The plurality of pressure relief valves may be fluidly coupled in parallel between the first and second annulus portions. Such apparatus may further comprise a plurality of plugs each movable to selectively prevent communication between the fluid and a corresponding one of the plurality of pressure relief valves. Each of the plurality of pressure relief valves may have a substantially different set pressure relative to each of the other pressure relief valves. The plurality of pressure relief valves may comprise: a first pressure relief valve having a first set pressure of about 500 pounds per square inch (psi); a second pressure relief valve having a second set pressure of about 1000 psi; and a third pressure relief valve having a third set pressure of about 2000 psi.

The apparatus may further comprise a biasing member positioned in the first annulus portion operable to urge the housing and the shaft towards the first position.

The present disclosure also introduces an apparatus comprising: a hydraulic jar coupled between opposing first and second portions of a downhole tool string, wherein the hydraulic jar comprises: a housing comprising a first longitudinal bore extending therethrough, wherein a substantial portion of the first longitudinal bore has a first diameter; a mandrel having a second longitudinal bore extending therethrough, wherein an annulus formed around the mandrel within the first longitudinal bore comprises a fluid, and wherein the housing and themandrel are moveable relatively in first and second axially opposing directions; an electrical conductor electrically coupling the first and second portions of the downhole tool string and extending through the second longitudinal bore; a piston carried with the mandrel and fluidly sealing against a reduced diameter section of the housing, wherein the reduced diameter section has a second diameter that is substantially less than the first diameter of the first longitudinal bore, and wherein the reduced diameter section collectively interposes first and second longitudinally offset portions of the annulus; and a pressure relief device controlling fluid communication from the first annulus portion to the second annulus portion based on a pressure of fluid in the first annulus portion and an electrical status of the electrical conductor.

The pressure relief device may prevent fluid communication from the first annulus portion to the second annulus portion when the pressure of fluid in the first annulus portion is less than a first pressure. The pressure relief device may permit fluid communication from the first annulus portion to the second annulus portion when the pressure of fluid in the first annulus portion is greater than the first pressure and less than a second pressure and the electrical status is a first electrical status but not a second electrical status. The pressure relief device may permit fluid communication from the first annulus portion to the second annulus portion when the pressure of fluid in the first annulus portion is greater than the second pressure and the electrical status is the second electrical status but not the first electrical status. The first electrical status may comprise the existence of a substantially non-zero voltage or current, and the second electrical status may comprise the existence of substantially no voltage or current. The first electrical status may comprise the existence of at least one of: a voltage greater than about 0.01 volts; and a current greater than about 0.001 amperes; and the second electrical status may comprise the existence of each of: a voltage less than about 0.01 volts; and a current less than about 0.001 amperes. The second electric status may comprise the existence of substantially no voltage or current. At least one of the first and second pressures may be adjustable without removing the pressure relief device from the apparatus.

The pressure relief device may comprise a plurality of pressure relief valves. The plurality of pressure relief valves may be collectively hydraulically coupled in parallel between the first and second annulus portions. Such hydraulic jar may further comprise a plurality of plugs, wherein each of the plurality of plugs is movable to selectively prevent communication between the fluid in the first annulus portion and a corresponding one of the plurality of pressure relief valves. Each of the plurality of pressure relief valves may have a substantially different set pressure relative to each of the other pressure relief valves. The plurality of pressure relief valves may comprise: a first pressure relief valve having a first set pressure of about 500 pounds per square inch (psi); a second pressure relief valve having a second set pressure of about 1000 psi; and a third pressure relief valve having a third set pressure of about 2000 psi.

The pressure relief device may selectively prevent fluid communication from the first annulus portion to the second annulus portion based on hydraulic pressure of the fluid within the first annulus portion.

The fluid may communicate from the first annulus portion to the second annulus portion when a hydraulic pressure of the fluid in the first annulus portion exceeds the set pressure of the pressure relief device, thereby allowing the mandrel to move in the first direction.

The mandrel may comprise a first impact feature, the housing may comprise a second impact feature, and the first and second impact features may impact each other after the piston and shoulder move sufficiently far apart.

The hydraulic jar may further comprise a biasing member positioned about the mandrel and operable to resist relative movement of the piston and the reduced diameter section of the housing away from each other.

The present disclosure also introduces a method comprising: conveying a tool string within a wellbore in a downhole direction, wherein a hydraulic jar coupled between uphole and downhole portions of the tool string comprises: a housing comprising a shoulder protruding radially inward from an internal surface of the housing; a shaft disposed within the housing, wherein the housing and the shaft move axially relative to each other, and wherein the shoulder axially interposes first and second portions of an annulus formed between the shaft and the housing; a piston fixedly positioned about the shaft and fluidly sealed against the shoulder; and a pressure relief device controlling fluid flow from the first annulus portion to the second annulus portion based on a pressure of the fluid in the first annulus portion relative to a set pressure of the pressure relief device; and operating the hydraulic jar to impart an impact to the downhole portion of the tool string.

The method may further comprise adjusting a set pressure of the pressure relief device prior to conveying the tool string within the wellbore and operating the hydraulic jar to impart the impact to the downhole portion of the tool string. The pressure relief device may comprise a plurality of individually activated pressure relief valves, and adjusting the set pressure of the pressure relief device may comprise activating at least one of a plurality of pressure relief valves. The pressure relief device may further comprise a plurality of plugs each operable with a corresponding one of the plurality of relief valves, and activating at least one of the plurality of pressure relief valves may comprise moving a corresponding one of the plurality of plugs to permit fluid communication between the first and second annulus portions via the at least one activated pressure relief valve.

The hydraulic jar may further comprise a flow control valve, and operating the hydraulic jar may comprise remotely operating the flow control valve to permit fluid communication through the pressure relief device after a predetermined tension is applied to the hydraulic jar. Remotely operating the flow control valve may comprise remotely operating the flow control valve with a solenoid to permit fluid communication through the pressure relief device after a predetermined tension is applied to the hydraulic jar.

The foregoing outlines features of several embodiments so that a person having ordinary skill in the art may better understand the aspects of the present disclosure. A person having ordinary skill in the art should appreciate that they may readily use the present disclosure as a basis for designing or modifying other processes and structures for carrying out the same purposes and/or achieving the same advantages of the embodiments introduced herein. A person having ordinary skill in the art should also realize that such equivalent constructions do not depart from the scope of the present disclosure, and that they may make various changes, substitutions and alterations herein without departing from the spirit and scope of the present disclosure.

The Abstract at the end of this disclosure is provided to comply with 37 C.F.R. §1.72(b) to allow the reader to quickly ascertain the nature of the technical disclosure. It is submitted with the understanding that it will not be used to interpret or limit the scope or meaning of the claims.

What is claimed is:

1. An apparatus, comprising:

a hydraulic jar coupled between opposing first and second portions of a downhole tool string, wherein the hydraulic jar comprises:

a housing comprising a shoulder protruding radially inward from an internal surface of the housing;

a shaft disposed within the housing, wherein the housing and the shaft move axially relative to each other, and wherein the shoulder axially interposes first and second portions of an annulus formed between the shaft and the housing;

a piston fixedly positioned about the shaft and fluidly sealed against the shoulder;

a pressure relief device controlling fluid flow from the first annulus portion to the second annulus portion based on a pressure of the fluid in the first annulus portion relative to a set pressure of the pressure relief device, wherein the pressure relief device comprises a plurality of pressure relief valves each selectable to relieve the fluid from the first annulus portion to the second annulus portion; and a plurality of plugs each movable to selectively prevent communication between the fluid and a corresponding one of the plurality of pressure relief valves.

2. The apparatus of claim 1 wherein the housing is substantially tubular.

3. The apparatus of claim 1 wherein the fluid is hydraulic oil.

4. The apparatus of claim 1 wherein the axially relative movement of the housing and the shaft is movable between:

a first position in which the piston fluidly seals against the shoulder; and a second position in which the piston is longitudinally offset from the shoulder, thus permitting the fluid to flow from the first annulus portion to the second annulus portion via a third annulus portion between the shoulder and the shaft.

5. The apparatus of claim 4 wherein, when the housing and the shaft are in the first position, the piston prevents fluid flow through the third annulus portion.

6. The apparatus of claim 5 wherein, when the pressure in the first annulus portion exceeds the set pressure of the pressure relief device, the fluid is communicated from the first annulus portion to the second annulus portion via the pressure relief device.

7. The apparatus of claim 6 wherein the housing and the shaft move away from the first position and toward the second position in response to the fluid being communicated from the first annulus portion to the second annulus portion via the pressure relief device.

8. The apparatus of claim 6 wherein the shaft comprises a first impact feature, wherein the housing comprises a second impact feature, and wherein the first and second impact features impact when the housing and the shaft are in the second position.

9. The apparatus of claim 1 wherein the plurality of pressure relief valves are fluidly coupled in parallel between the first and second annulus portions.

10. The apparatus of claim 1 wherein each of the plurality of pressure relief valves has a substantially different set pressure relative to each of the other pressure relief valves.

11. The apparatus of claim 1 wherein the plurality of pressure relief valves comprises:

a first pressure relief valve having a first set pressure of about 500 pounds per square inch (psi);

a second pressure relief valve having a second set pressure of about 1000 psi; and a third pressure relief valve having a third set pressure of about 2000 psi.

12. The apparatus of claim 1 further comprising a biasing member positioned in the first annulus portion operable to urge the housing and the shaft towards the first position.

13. A method, comprising:

conveying a tool string within a wellbore in a downhole direction, wherein a hydraulic jar coupled between uphole and downhole portions of the tool string comprises:

a housing comprising a shoulder protruding radially inward from an internal surface of the housing;

a shaft disposed within the housing, wherein the housing and the shaft move axially relative to each other, and wherein the shoulder axially interposes first and second portions of an annulus formed between the shaft and the housing;

a piston fixedly positioned about the shaft and fluidly sealed against the shoulder; and a pressure relief device controlling fluid flow from the first annulus portion to the second annulus portion based on a pressure of the fluid in the first annulus portion relative to a set pressure of the pressure relief device, wherein the pressure relief device comprises a plurality of individually activated pressure relief valves;

operating the hydraulic jar to impart an impact to the downhole portion of the tool string; and adjusting a set pressure of the pressure relief device by activating at least one of the plurality of individually activated pressure relief valves prior to conveying the tool string within the wellbore and operating the hydraulic jar to impart the impact to the downhole portion of the tool string.

14. The method of claim 13 wherein the pressure relief device further comprises a plurality of plugs each operable with a corresponding one of the plurality of relief valves, and wherein activating at least one of the plurality of pressure relief valves comprises moving a corresponding one of the plurality of plugs to permit fluid communication between the first and second annulus portions via the at least one activated pressure relief valve.

15. The method of claim 13 wherein the hydraulic jar further comprises a flow control valve, and wherein operating the hydraulic jar comprises remotely operating the flow control valve to permit fluid communication through the pressure relief device after a predetermined tension is applied to the hydraulic jar.

16. The method of claim 15 wherein remotely operating the flow control valve comprises remotely operating the flow control valve with a solenoid to permit fluid communication through the pressure relief device after a predetermined tension is applied to the hydraulic jar.

17. An apparatus, comprising:

a hydraulic jar coupled between opposing first and second portions of a downhole tool string, wherein the hydraulic jar comprises:

a housing comprising a shoulder protruding radially inward from an internal surface of the housing;

a shaft disposed within the housing, wherein the housing and the shaft move axially relative to each other, and wherein the shoulder axially interposes first and second portions of an annulus formed between the shaft and the housing;

a piston fixedly positioned about the shaft and fluidly sealed against the shoulder; and a pressure relief device controlling fluid flow from the first annulus portion to the second annulus portion based on a pressure of the fluid in the first annulus portion relative to a set pressure of the pressure relief device, wherein the pressure relief device comprises a plurality of pressure relief valves each selectable to relieve the fluid from the first annulus portion to the second annulus portion, and wherein each of the plurality of pressure relief valves has a substantially different set pressure relative to each of the other pressure relief valves.

18. An apparatus, comprising:

a hydraulic jar coupled between opposing first and second portions of a downhole tool string, wherein the hydraulic jar comprises:

a housing comprising a shoulder protruding radially inward from an internal surface of the housing;

a shaft disposed within the housing, wherein the housing and the shaft move axially relative to each other, and wherein the shoulder axially interposes first and second portions of an annulus formed between the shaft and the housing;

a piston fixedly positioned about the shaft and fluidly sealed against the shoulder; and a pressure relief device controlling fluid flow from the first annulus portion to the second annulus portion based on a pressure of the fluid in the first annulus portion relative to a set pressure of the pressure relief device, wherein the pressure relief device comprises a plurality of pressure relief valves each selectable to relieve the fluid from the first annulus portion to the second annulus portion, and wherein the plurality of pressure relief valves comprises:

a first pressure relief valve having a first set pressure of about 500 pounds per square inch (psi);

a second pressure relief valve having a second set pressure of about 1000 psi; and a third pressure relief valve having a third set pressure of about 2000 psi.

* * * * *